US005825127A

United States Patent [19]

Weinhardt

[11] Patent Number: 5,825,127

[45] Date of Patent: Oct. 20, 1998

[54] METHOD FOR PRODUCING A CAP BAND FOR DISCHARGE LAMPS

[75] Inventor: Erolf Weinhardt, Diedorf, Germany

[73] Assignee: Patent-Treuhand-Gesellschaft für elektrische Glühlampen mbH, Munich, Germany

[21] Appl. No.: 765,769

[22] PCT Filed: May 28, 1996

[86] PCT No.: PCT/DE96/00924

§ 371 Date: Jan. 8, 1997

§ 102(e) Date: Jan. 8, 1997

[87] PCT Pub. No.: WO97/00532

PCT Pub. Date: Jan. 3, 1997

[30] Foreign Application Priority Data

Jun. 16, 1995 [DE] Germany ..... 195 21 972.4

[51] Int. Cl.[6] ..... H01J 61/24

[52] U.S. Cl. ..... 313/553; 313/559; 313/560; 72/51

[58] Field of Search ..... 313/553, 556, 313/558, 559, 560, 562, 563, 564, 565, 566; 445/9, 55, 41; 72/47, 137, 379.2, 377, 700.51

[56] References Cited

U.S. PATENT DOCUMENTS

| | | | |
|---|---|---|---|
| 2,515,179 | 7/1950 | Barger | 72/51 X |
| 3,525,009 | 8/1970 | Someya et al. . | |
| 3,544,829 | 12/1970 | Someya et al. . | |
| 3,549,936 | 12/1970 | Hama et al. . | |
| 3,549,937 | 12/1970 | Hanada et al. . | |
| 3,657,589 | 4/1972 | Della Porta et al. . | |
| 4,461,981 | 7/1984 | Saikatsu et al. | 313/553 X |
| 4,706,488 | 11/1987 | Williamson | 72/51 X |
| 4,855,643 | 8/1989 | White | 313/553 |

FOREIGN PATENT DOCUMENTS

| | | |
|---|---|---|
| 6076796 | 3/1994 | Japan . |
| 6096728 | 4/1994 | Japan . |
| 60-193253 | 10/1995 | Japan . |

OTHER PUBLICATIONS

Japanese Journal of Applied Physics, Suppl. 2, Pt. 1, pp. 45–48, Dec. 1974, P. della Port et al, "Mercury Dispensing and Gettering in Fluorescent Lamps".

*Primary Examiner*—Ashok Patel

*Attorney, Agent, or Firm*—Frishauf, Holtz, Goodman, Langer & Chick, P.C.

[57] ABSTRACT

The invention relates to a method for producing a cap band for discharge lamps, in which a substrate band (1) is coated with at least one material to be introduced into the discharge lamp, in particular a mercury alloy (2) and/or getter material (3).

According to the invention, a portion (5) of the substrate band (1) is severed in a direction transversely to the longitudinal direction of the substrate band (1) to form the cap band for the discharge lamp, so that the cap band, or portion, is coated over its entire width (BT) with the at least one material.

19 Claims, 3 Drawing Sheets

METHOD FOR PRODUCING A CAP BAND FOR DISCHARGE LAMPS

FIELD OF THE INVENTION

The invention relates to a method to produce a cap band for discharge lamps in which a substrate band is coated with a material to be introduced into a discharge lamp, especially a mercury alloy and/or a getter material; and to a cap band made by the method.

BACKGROUND

Published, Unexamined Japanese patent application 6-96728, discloses a low-pressure mercury vapor discharge lamp. This discharge lamp has a metal ring cap, which comprises two metal ring portions, in which one portion has a mercury-dispensing function while the other metal portion has no such function. The first of these metal portions comprises a nickel-coated iron substrate and a mercury alloy, which comprises a mercury-titanium alloy powder applied to the substrate.

The mercury alloy is located on one side, the inside of the ring portion, while getter is located on the other side, the outside of the ring portion. The amount of mercury to be introduced into the discharge lamp is determined by varying the length of the first portion. That is, if the amount of mercury is to be increased, the length of the first metal portion mentioned above is increased.

The ring cap of the previously known discharge lamp is accordingly not formed in one piece but rather comprises a plurality of components. This increases both the costs of production of the ring cap and the costs of production of the discharge lamp.

THE INVENTION

Briefly, a substrate band, having a width of the length of the entire cap band to be formed, or at least a portion thereof, is coated with at least one material to be introduced into the discharge lamp, typically a mercury alloy and/or a getter material. This base or substrate band is severed transversely to its longitudinal direction, to then form the cap band, or a portion thereof, for example in combination with an uncoated cap band strip.

According to the invention, this object is attained by a

The invention has the advantage that from a predetermined length of cap band produced by the method of the invention, many portions can be made, and each portion can be processed, e.g. by cutting in a simple way, in particular to make a one-piece ring cap.

As an example, the width of the substrate band used in the method of the invention is approximately 12 to 55 mm. If one assumes that for a ring cap a 5-millimeter-wide cap band should be provided, then from one running meter of, for example, 42 mm width, of substrate band, 200 cap bands can be made by the method of the invention; that is, 199 cuts are required. In the prior art, in which a substrate band has a width of 5 to 7 mm, only 23 cap bands can be made from 1 meter of substrate to provide caps with full ring cap circumference of 42 mm.

The application of getter and mercury alloy is multiple times more expensive than the material itself. If according to the invention cutting is done crosswise to the application of material, and moreover coating is done on one side, then the production speed for one portion (cap band) is multiple times greater (depending on the width BT, FIGS. 3, 4), for the same machine speed.

In a further advantageous embodiment of the method of the invention, the cap band is produced by coating the substrate band on one side with the at least one material to be introduced into the discharge lamp, and in particular with two materials namely with a mercury alloy and getter. This has the advantage, among others, that the coating of the two materials on the substrate band can be done simultaneously.

DRAWINGS

The invention will now be described in conjunction with the drawing.

Shown are in:

FIG. 1, a ring cap for a discharge lamp of the prior art;

FIG. 2, a cap band of the prior art;

FIG. 3A, a sectional view of a first embodiment of a cap band, produced by the method of the invention, coated on both sides;

FIG. 3B, a top view of FIG. 3A;

FIG. 4A, a sectional view of a second embodiment of a cap band, produced by the method of the invention, coated on one side;

FIG. 4B, a top view of FIG. 4A; and

FIGS. 5 and 6, two exemplary embodiments of a ring cap produced from a cap band according to the invention.

DETAILED DESCRIPTION

Figure 1:
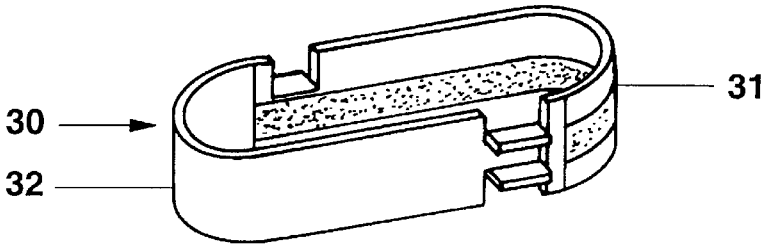
PRIOR ART FIG. 1
Figure 2:
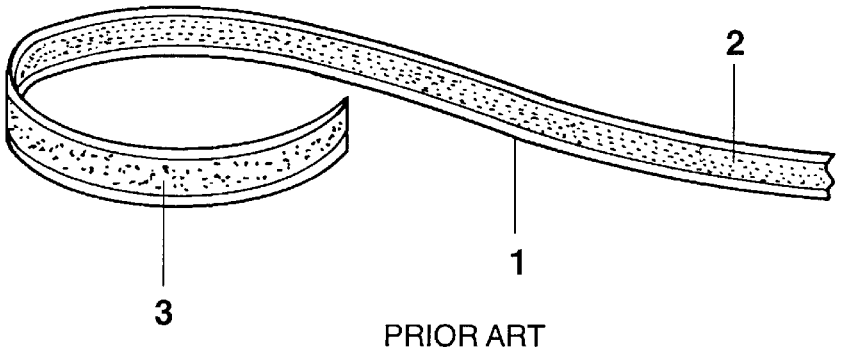
PRIOR ART FIG. 2

The ring cap shown in FIG. 1 for a discharge lamp comprises a two-piece oval ring 30, which comprises a first metal piece 31 and a second metal piece 32. The first metal piece may be formed by a cap band, which is shown in FIG. 2.

In FIG. 3, an exemplary embodiment of a cap band produced by the method of the invention is shown. The width BB of a substrate band 1 is selected such that it is equal to the circumference of the respective ring cap of the discharge lamp. The substrate band 1, that is, a metal band, which has the length LB, is coated with at least one material to be introduced, particularly by heating, into the discharge lamp. Preferably, the substrate band 1, which for instance comprises nickel-coated sheet iron, is coated with a mercury alloy 2 and/or getter material 3, for instance by rolling. The coating does not extend over the entire width of the substrate band, but leaves uncoated margins 6.

Figure 3A:
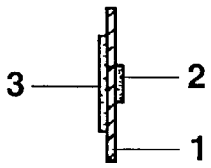

The cap band 4 produced by the method of the invention may be formed by one-sided or two-sided coating of the substrate band. Examples for these embodiments of the cap band are shown in FIGS. 3A, 3B, 4A and 4B. FIG. 3A shows a cap band in which the substrate band 1 is coated on one side with getter material 3 and on the other side with a mercury alloy 2. A portion 5 that forms the cap band 4 for a discharge lamp is severed from the substrate band 1 transversely to its longitudinal direction LB (which as a rule is the direction in which the material is applied). When the portion 5 is installed in a lamp, the cap band will have coating over its entire width BT with at least one material, see FIGS. 5 and 6, and compare with FIG. 1.

The cap band produced by the method of the invention has a length LT in the range of approximately 12 to 55 mm, for instance. The respective length LT, as already noted, is equivalent to the circumference of the respective ring cap of the discharge lamp for instance, 48 mm for a T8 low-pressure mercury vapor discharge lamp with a diameter of 8/8 inches.

Figure 4A:
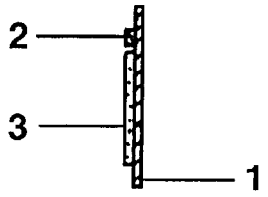
Figure 4B:
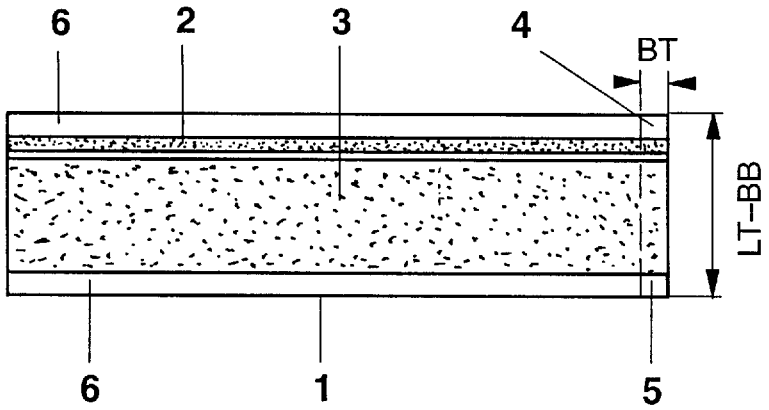

The cap band shown in FIGS. 4A and 4B, produced by the method of the invention, is coated on one side. Getter material and the mercury alloy are accordingly located on the same side of the cap band. The cap band shown in FIG. 4A has a width of 44 mm.

Figure 3B:
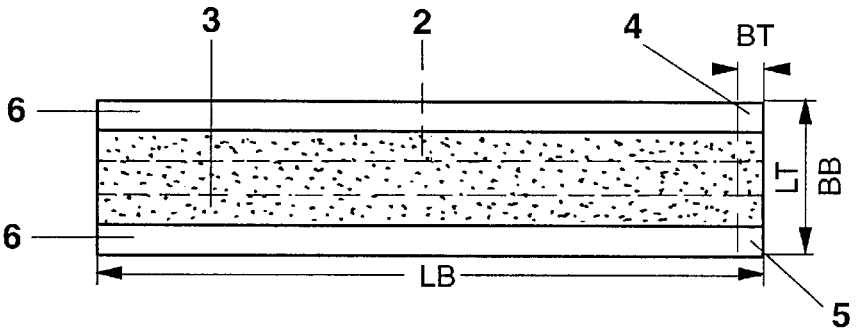

In FIGS. 3A and 4A, a portion 5 that is 5 mm in width is shown on the right-hand side of the substrate band 4 of FIGS. 3B and 4B of each. According to the invention, from the running substrate band, for instance as it is shown in FIGS. 3A and 4A, portions 5 are cut, each having a width BT of 5 mm (length LT of the portion 5=width BB of the substrate band 1=circumference of the ring cap=44 mm). By the determination of the width BT of the portion, in the present case 5 mm, the quantity of material (mercury alloy and/or getter) to be introduced by heating into the discharge lamp is determined. On the other hand, the quantity of material to be applied per unit of length of substrate band is determined width BT of the cap band being as strong as possible view to a possible fixed width BT of the cap band.

A cap band produced by the method of the invention as described is used to produce a discharge lamp, in such a way that it is introduced into the discharge lamp and secured therein.

According to the invention, this cap band has a length that is equal to the circumference of a ring cap of the discharge lamp (such as 44 mm). The width of the portion or of the cap band is 5 mm, for instance, and this width is chosen as a function of the material to be introduced into the discharge lamp. Accordingly, the substrate band is coated in such a way that the quantity of material or materials intended for the discharge lamp is applied over a substrate band portion that is intended for a discharge lamp and has a predetermined width BT, for instance of 5 to 7 mm.

The portion is optionally curved into the specified shape, introduced into the discharge lamp, and secured there.

A discharge lamp according to the invention thus has a cap band 4 of the kind described above and claimed.

Figure 5:
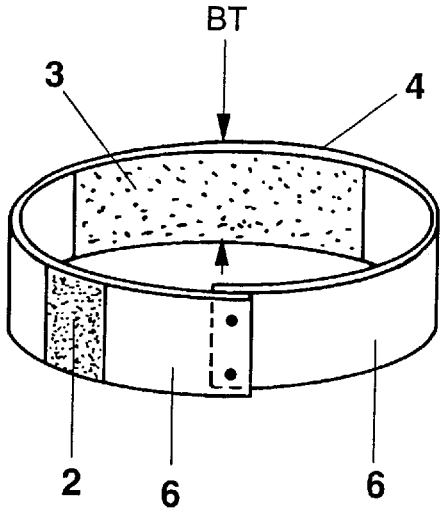
Figure 6:
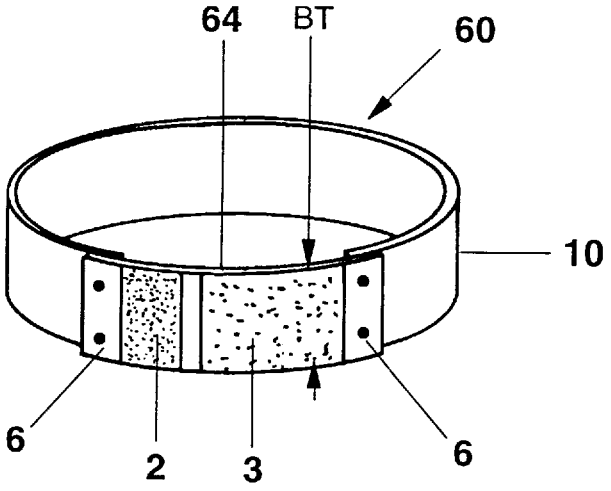

The ring cap shown in FIG. 5 comprises solely a cap band 4 according to the invention, which is welded on its ends, while the ring cap 60 shown in FIG. 6 comprises one cap band according to the invention and one further band 10, the portion 64 and the further band being welded to one another.

I claim:

1. A method for producing a cap band for discharge lamps, comprising the steps of providing a substrate band (1) coated with material to be introduced into the discharge lamp, optionally at least one of: a mercury alloy (2) and a getter material (3), said method comprising the steps of severing, transversely to the longitudinal direction (LB) of the substrate band (1), a portion (5) of the substrate band, said portion forming the cap band (4, 60) or a portion (64) of the cap band, which is coated over its entire width (BT) with the material.

2. The method of claim 1, characterized in that the substrate band (1) has a width (BB) that is equal to the circumference of a ring cap of the discharge lamp.

3. A method in accordance with claim 1, characterized in that the cap band is produced by one-sided coating of the substrate band (1) with the material to be introduced into the discharge lamp.

4. The method of claim 1, characterized in that said material comprises at least one of a mercury alloy and a getter.

5. The method of claim 1, characterized in that the substrate band (1) has a width (BB) in the range from approximately 12 to 55 mm.

6. The method of claim 1, characterized in that the severing step comprises severing the portion (5) of the substrate band (1) forming the cap band (4, 60) to have a dimension such that said portion forming said cap, intended for the discharge lamp, has that quantity of the material or materials applied which is intended or destined for the discharge lamp.

7. A method for producing a discharge lamp, utilizing a cap band (4, 60), comprising carrying out the method of claim 1; and introducing and securing said so-severed portion in the discharge lamp.

8. A cap band for a discharge lamp, wherein the cap band (4, 60) is coated with material to be introduced into the discharge lamp, optionally at least one of a mercury alloy and a getter material, characterized in that the cap band (4, 60) or a portion (64) of the cap band (60), severed, transversely to the longitudinal direction of a substrate band, is coated over its entire width (BT) with said material; and wherein said cap band (4, 60), or at least said portion (64) of the cap band, are made according to the method of claim 1.

9. The cap band of claim 8, characterized in that the cap band (4) has a length (LT) which is equal to the circumference of a ring cap of the discharge lamp.

10. A discharge lamp having the cap band of claim 9.

11. The cap band of claim 8, characterized in that the cap band (4, 60) is coated on one side with the material to be introduced into the discharge lamp.

12. A discharge lamp having the cap band of claim 11.

13. The cap band of claim 8, characterized in that it is coated with at least one of: a mercury alloy (2) and a getter (3).

14. A discharge lamp having the cap band of claim 13.

15. The cap band of claim 8, characterized in that it has a length (LT) of approximately 12 to 55 mm.

16. A discharge lamp having the cap band of claim 15.

17. The cap band of claim 8, characterized in that with a full width (BT) of approximately 5 to 7 mm, the cap band has the quantity of the material or materials applied thereon intended or destined for a discharge lamp.

18. A discharge lamp having the cap band of claim 17.

19. A discharge lamp having the cap band of claim 8.

* * * * *